US006807940B2

(12) United States Patent
Bootle

(10) Patent No.: US 6,807,940 B2
(45) Date of Patent: Oct. 26, 2004

(54) GOVERNOR

(75) Inventor: Geoffrey D Bootle, Maidstone (GB)

(73) Assignee: Delphi Technologies, Inc., Troy, MI (US)

( * ) Notice: Subject to any disclaimer, the term of this patent is extended or adjusted under 35 U.S.C. 154(b) by 242 days.

(21) Appl. No.: 10/054,133

(22) Filed: Nov. 13, 2001

(65) Prior Publication Data

US 2002/0096141 A1 Jul. 25, 2002

(51) Int. Cl.[7] ..... F02D 31/00
(52) U.S. Cl. ..... 123/373; 123/365
(58) Field of Search ..... 123/373, 371, 123/370, 372, 365

(56) References Cited

U.S. PATENT DOCUMENTS

| | | | | |
|---|---|---|---|---|
| 2,571,571 A | * | 10/1951 | Hanners et al. | 123/370 |
| 3,640,258 A | * | 2/1972 | Isobe et al. | 123/365 |
| 3,672,385 A | * | 6/1972 | Matzen | 137/53 |
| 4,176,642 A | * | 12/1979 | Shipinski | 123/366 |
| 4,498,437 A | * | 2/1985 | Ohkoshi et al. | 123/373 |
| 4,612,891 A | * | 9/1986 | Doveri | 123/373 |
| 4,664,079 A | * | 5/1987 | Sakuranaka et al. | 123/370 |
| 4,735,180 A | * | 4/1988 | Kramer | 123/364 |
| 4,884,542 A | * | 12/1989 | Konrath et al. | 123/370 |
| 5,193,505 A | * | 3/1993 | Straubel et al. | 123/366 |
| 5,535,721 A | * | 7/1996 | Lewis et al. | 123/359 |
| 5,752,483 A | * | 5/1998 | Greaney et al. | 123/373 |
| 6,263,861 B1 | | 7/2001 | Bootle | |
| 6,360,716 B1 | | 3/2002 | Bootle | |
| 6,443,127 B1 | | 9/2002 | Bootle et al. | |

FOREIGN PATENT DOCUMENTS

| | | |
|---|---|---|
| DE | 4306811 | 9/1993 |
| EP | 760423 | 5/1997 |
| GB | 2015192 | 9/1979 |
| GB | 2195470 | 4/1988 |
| JP | 9072223 | 3/1997 |
| JP | 9072224 | 3/1997 |

* cited by examiner

*Primary Examiner*—Carl S. Miller
(74) *Attorney, Agent, or Firm*—David P. Wood

(57) ABSTRACT

A governor for use in an engine provided with an overspeed protection device arranged to trip in the event that engine speed exceeds a predetermined speed. The governor comprises a centrifugal weight mechanism comprising at least one weight coupled to an angularly adjustable metering valve member through a lever member, the metering valve member being operable to control the level of fuelling of the associated engine depending on engine speed. The governor further comprises a damping arrangement associated with the lever member which is arranged to damp oscillatory movement of the lever member, in use, and a prevention arrangement for preventing the overspeed protection device associated with the engine tripping upon engine start up.

20 Claims, 3 Drawing Sheets

GOVERNOR

FIELD OF THE INVENTION

This invention relates to a governor for use in controlling the rate at which fuel is supplied to a fuel pump, and thus for use in controlling the operation of an engine of the compression ignition type.

BACKGROUND OF THE INVENTION

A governor for use with a diesel engine of an alternator and generator set typically includes a centrifugal weight mechanism arranged to rotate at a speed associated with engine speed and to act upon a spring biased lever. The lever is coupled to an angularly movable fuel metering valve such that movement of the lever is transmitted to the valve to adjust the setting of the valve. In particular, the governor is arranged such that, in the event that the load on the engine changes, a corresponding change in the fuelling of the engine is made to control the engine in such a manner that it operates at a substantially constant speed. It is known to provide the lever of the governor with a stabiliser device or damping arrangement which serves to damp oscillations of the engine under certain load and fuelling conditions which can otherwise adversely affect operation of the governor.

In order to permit the governor to be adaptable for use in, for example, different types of engine and with different types of engine fuel pump, the governor is arranged such that the governor arm has a longer stroke than is required to give the necessary variation in fuelling level. The metering valve is therefore moved through a region of "dead travel", in which no variation in fuelling occurs, before the region of travel in which a variation in fuelling does occur is reached. However, if the lever arm is provided with a damping arrangement, movement of the metering valve through the region of dead travel can cause an undesirable delay in the change of fuelling from the maximum fuel setting to that necessary to achieve the desired speed upon engine start up.

Furthermore, in internal combustion engines provided with an overspeed protection device which is arranged to trip so as to halt engine operation in the event that the engine speed exceeds a predetermined, maximum safe speed at a given rate of engine rotation, any delay in control of fuelling due to movement of the metering valve through the region of dead travel can cause the overspeed protection device to trip inadvertently upon engine start up. As a result, engine operation may be halted in undesirable circumstances.

It is an object of the present invention to provide a governor which alleviates this problem.

SUMMARY OF THE INVENTION AND ADVANTAGES

According to the present invention, there is provided a governor for use in an engine provided with an overspeed protection device arranged to trip in the event that engine speed exceeds a predetermined speed, the governor comprising a centrifugal weight mechanism comprising at least one weight coupled to an angularly adjustable metering valve member through a lever member, the metering valve member being operable to control the level of fuelling of the associated engine, the governor further comprising a damping arrangement associated with the lever member which is arranged to damp oscillatory movement of the lever member, in use, and prevention means for preventing the overspeed protection device associated with the engine tripping upon engine start up.

The engine typically comprises a drive shaft which is arranged to rotate at a speed associated with the engine, the or each weight being pivotable with respect to and rotatable with the drive shaft, the or each weight being arranged to engage a washer member which is interposed between the or each weight and a thrust sleeve member which is cooperable with the lever member such that pivotal movement of the or each weight results in axial movement of the thrust sleeve member and, hence, pivotal movement of the lever member.

The metering valve member is arranged to have a range of travel including a region of dead travel in which substantially no variation in fuelling of the engine occurs.

In one embodiment of the invention, the prevention means comprise means for limiting the range of travel of the metering valve member.

The means for limiting the range of travel of the metering valve member may take the form of an adjustment member associated with the lever member, the adjustment member acting on the lever member so as to limit the extent of movement of the lever member and, hence, the extent of angular movement of the metering valve member.

Typically, the adjustment member may take the form of an adjustment screw. Preferably, the adjustment screw is adjusted such that the metering valve member does not move through the region of dead travel upon engine start up.

The invention provides the advantage that, as the extent of movement of the metering valve member is limited to only that region for which a variation in fuelling occurs, there is no delay in control of fuelling upon engine start up. Hence, inadvertent tripping of the overspeed protection device is avoided.

The invention also provides the advantage that the governor can be adapted for use in engines of different type and with different kinds of engine fuel pump. It can also be adjusted to compensate for manufacturing tolerances and can be adjusted throughout the service life of the governor to compensate for wear.

The adjustment member may be arranged to act directly on the lever member, or may be arranged to act on the damping arrangement associated with the lever member.

Preferably, the governor is provided with first resilient bias means for urging the thrust sleeve member towards the thrust washer member upon engine start up. Typically, the first resilient bias means take the form of a first spring which may be arranged to act on the thrust sleeve member through the lever member.

The provision of the first resilient bias means provides the advantage that, even though the metering valve member is at the end of the region of dead travel upon engine start up, the weights adopt their radially innermost position.

The governor preferably comprises further resilient bias means which serve to urge the lever member against the thrust sleeve member, thereby serving to urge the thrust sleeve member towards the or each weight. The further resilient bias means typically take the form of a further spring.

The provision of the further spring serves to urge the lever member into engagement with the thrust sleeve member such that, upon engine start-up, the thrust washer member rotates with the or each weight.

The damping arrangement may take the form of a hydraulic damping arrangement which may comprise a damping piston, a working chamber for receiving a fluid, whereby fluid pressure within the working chamber acts on a surface associated with the damping piston, and a restricted outlet for permitting fluid to flow into and out of the working chamber at a relatively low rate.

Preferably, the damping piston is slidable within a bore provided in a housing against a damping spring means, the bore defining a working chamber for receiving a fluid which applies a force on the damping piston to oppose the damping force.

The damping arrangement may include an anchor member which is adjustable to vary a pre-load of the damping spring means.

In one embodiment of the invention, the damping arrangement may be provided with by-pass means to permit fluid to flow out of the working chamber at a higher, relatively unrestricted rate, thereby by-passing the restricted outlet and causing the damping arrangement to be disabled.

For example, the damping arrangement may be provided with an additional outlet through which fluid can flow at a relatively unrestricted rate compared to the rate of flow of fluid through the restricted outlet, the damping piston being movable between a first position in which the additional outlet is obscured by the damping piston, in which case the damping arrangement is enabled, and a second position in which the additional outlet is not obscured by the damping piston, the additional outlet thereby providing a by-pass flow path for fluid flowing into and out of the working chamber to disable operation of the damping arrangement.

Preferably, the by-pass flow path may be defined, in part, by a passage provided in the damping piston in communication with the working chamber and whereby, when the damping piston is in the second position, the passage communicates with the additional outlet.

Preferably, the damping spring means is arranged such that the damping arrangement is disabled during movement of the metering valve member through the region of dead travel upon engine start up.

In this embodiment of the invention, as the damping arrangement is disabled upon engine start up when the metering valve member moves through the region of dead travel, inadvertent tripping of the overspeed protection device is avoided.

The damping arrangement may further comprise a further adjustment member for adjusting the damping spring means such that the damping piston occupies a position in which the working chamber communicates with the additional outlet during the dead travel region of the metering valve member.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
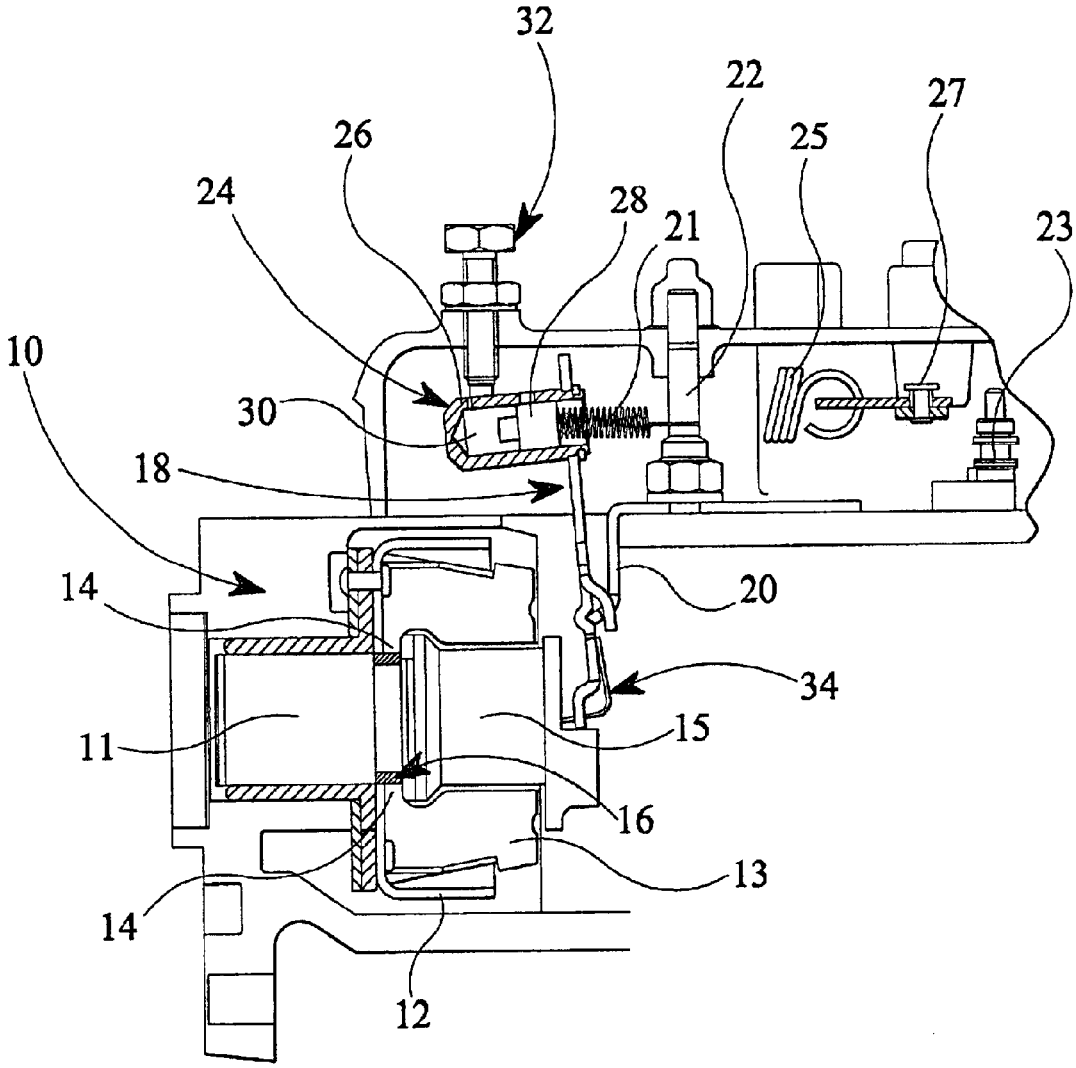
FIG. 1 is a diagrammatic view of a governor in accordance with an embodiment of the invention.

Referring to FIG. 1, there is shown a governor including a centrifugal weight mechanism 10 mounted upon a drive shaft 11 which is arranged to rotate at a speed associated with the operating speed of an associated engine, for example camshaft or crankshaft speed. The drive shaft 11 carries a cage 12, the cage being rotatable with the drive shaft 11. The weight mechanism includes a plurality of weights 13 which are pivotally mounted within the cage 12, each of the weights 13 including a projection 14 which is engagable with an end surface of a thrust sleeve member 15 carried by and axially adjustable relative to the drive shaft 11. A thrust washer member 16 encircles the drive shaft 11, the thrust washer 16 being interposed between the projections 14 of the weights 13 and a free end region of the thrust sleeve 15. The drive shaft 11 is also provided with an annular groove (not shown in FIG. 1) within which a rubber ring is seated to provide a clutch mechanism, as described in EP 0 760 423 A1, the contents of which are incorporated herein by reference.

The thrust sleeve member 15 abuts a lever member or governor arm 18, the lever member 18 being pivotal about a further arm 20. The lever arm 18 is coupled to a governor spring 25, the governor spring 25 being arranged to engage a throttle member 27 which is adjustable to vary the pre-load applied to the governor spring 25. For clarity, only a part of the governor spring 25 is shown in FIG. 1, such that the coupling between the lever member 18 and the spring 25 cannot be seen.

In use, when the engine is operating at a relatively low speed, and hence the shaft 11 rotates at a relatively low speed, the action of the governor spring 25 upon the lever member 18 applies a force to the thrust sleeve 15 urging the thrust sleeve 15 towards the left in the orientation illustrated in FIG. 1, engagement between the thrust sleeve 15 and the weights 13, through the thrust washer 16 and the rubber ring of the clutch mechanism, ensuring the weights 13 occupy a radially inner position. As the engine speed increases, the centrifugal force resulting from the increased speed of rotation of the shaft 11 urges the weights 13 to pivot towards radially outer positions, such movement causing translation of the thrust sleeve 15 and pivotal movement of the lever member 18 against the action of the governor spring 25.

A further spring 34 may also be provided which serves to urge the lever member 18 into engagement with the thrust sleeve 15 such that, upon engine start up, the thrust washer 16 is urged against the rubber ring of the clutch mechanism, thereby ensuring the thrust washer 16 rotates with the weights 13. The provision of the further spring 34 may be desirable in this embodiment of the invention, and particularly if the aforementioned clutch mechanism is provided, as it ensures the thrust washer 16 is urged into engagement with the rubber ring of the clutch mechanism upon engine-start up. The spring rate of the further spring 34 is selected such that the force acting on the lever member 18 (taking into account the lever ratio) does not impede the effect of the governor spring 25 when the engine is running. Thus, the further spring 34 is collapsed before the metering valve member 23 reaches the end of the region of dead travel.

The lever member 18 is coupled through a conventional coupling arrangement to a metering valve member 23 forming part of a metering valve arrangement, the metering valve member being angularly movable through a range of movement in response to pivotal movement of the lever member 18 so as to vary the level of fuelling to the engine. Angular movement of the metering valve member varies the amount by which an outlet of the metering valve arrangement is obscured so as to vary the rate of flow of fuel through the metering valve arrangement, as would be familiar to a person skilled in the art. In the view shown in FIG. 1, it will be appreciated that the coupling between the lever member 18 and the metering valve member 23 is not visible.

The lever member 18 is provided with a damping arrangement or stabiliser device, referred to generally as 24, comprising a housing 26 provided with a bore within which a damping piston 28 is slidable. One end of the damping piston 28 is in abutment or connection with damping spring means in the form of a damping spring 21, the other end of the damping piston 28 being exposed to fluid pressure within a working chamber 30. A force due to fluid pressure within the working chamber 30 serves to oppose the biasing force of the damping spring 21. The damping spring 21 engages an anchor member 22 which is adjustable to vary the pre-load applied to the damping spring 21. The housing 26 is provided with a restricted outlet (not shown) which permits fluid to flow into and out of the working chamber 30 at a relatively low rate as the damping piston 28 moves within the bore of the housing 26, the damping arrangement 24 therefore taking the form of a conventional hydraulic damping arrangement which serves to damp oscillations of the lever member 18.

The governor also includes an adjustment member in the form of an adjustment screw 32 which is arranged to engage the housing 26 of the damping arrangement 24 so as to limit the extent of pivotal movement of the lever member 18. By adjusting the position of the adjustment member 32 so as to limit the range of pivotal movement of the lever member 18, the extent of travel of the metering valve member 23 is also limited. It will therefore be appreciated that it is possible to adjust the adjustment screw 32 so as to ensure the metering valve member 23 does not pass through the region of dead travel, in which no variation in the level of fuelling occurs, upon engine start up.

Figure 2:
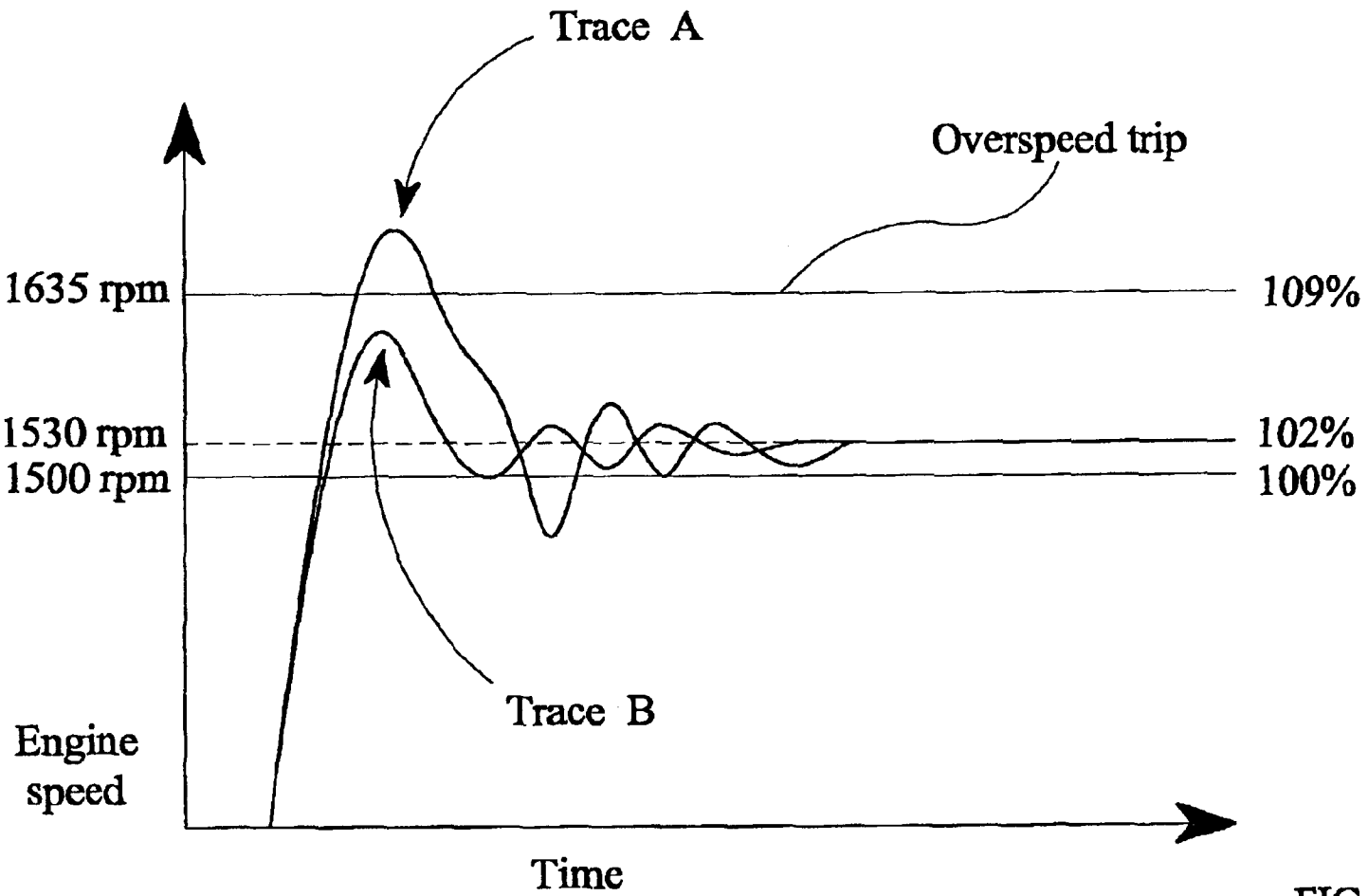
FIG. 2 is a diagram to illustrate the variation in engine speed with time for an engine in which the governor in FIG. 1 may be used.

In conventional governor arrangements, it is known to arrange the lever member such that it has a stroke which causes movement of the metering valve member beyond the region of travel in which a variation in fuelling occurs. This enables the governor to be adapted relatively easily for use in engines of different type, and to compensate for manufacturing tolerances and wear during the service life of the governor. However, the metering valve member must therefore pass through a region of dead travel before a variation in fuelling level is achieved, thereby causing a delay in fuelling control upon engine start up. In engines in which an overspeed protection device is provided to limit the engine start up speed such that it does not exceed a predetermined, safe speed, this delay can cause the overspeed protection device to trip, thereby halting engine operation inadvertently. By way of example, FIG. 2 illustrates the relationship between engine speed and time upon engine start up in an engine for which a conventional governor is employed, and in which Trace A represents engine speed when there is a relatively long delay in fuelling control upon engine start up due to movement of the metering valve member through the region of dead travel. Typically, the overspeed protection device is arranged to trip if engine speed exceeds a predetermined safe speed at a given engine rotation rate of between 9% and 11% above nominal engine speed. It can be seen that engine speed upon engine start up exceeds that at which the overspeed protection device trips, thereby causing engine operation to be halted inadvertently.

The present invention provides the advantage that, by adjusting the adjustment member 32 to limit the extent of pivotal movement of the lever member 18, and hence the extent of angular movement of the metering valve member 23 to that beyond the region of dead travel, it is possible to avoid such a delay upon engine start up. Referring to FIG. 2, Trace B represents engine speed as a function of time when the adjustment member 32 is adjusted to limit the range of angular movement of the metering valve member 23 to that beyond the region of dead travel, thereby avoiding any delay in control of fuelling upon engine start up. The present invention therefore prevents the overspeed protection device from tripping inadvertently.

It will further be appreciated that the adjustment member 32 can be adjusted to suit the particular application of the governor, depending on the range of metering valve member movement over which a variation in fuelling level occurs. The governor can therefore be adapted readily for use in different engine types and with different engine fuel pumps. Differences in manufacturing tolerance can also be compensated for by adjusting the adjustment member 32 to limit the extent of movement of the metering valve member 23, as required.

One potential drawback of providing the adjustment screw 32 to limit the extent of movement of the lever member 18 is that the governor spring 25 may be prevented from urging the thrust washer 16 against the rubber ring of the clutch mechanism upon engine start-up. The provision of the further spring 34, however, overcomes this problem.

In an alternative embodiment to that shown in FIG. 1, the adjustment member 32 may be arranged to co-operate directly with the lever member 18. For example, the adjustment member may extend generally parallel to the drive shaft 11, the adjustment member 32 engaging a region of the lever member underneath the damping arrangement 24 in the orientation shown in FIG. 1. However, the illustrated embodiment provides the advantage that construction of the governor is simplified.

In a further alternative embodiment to that shown in FIG. 1, an additional member may be arranged between the adjustment member 32 and the damping arrangement. In this case the adjustment member 32 acts on the additional member, rather than on the damping arrangement 24, so as to prevent damage being caused to the damping arrangement 24.

Figure 3:
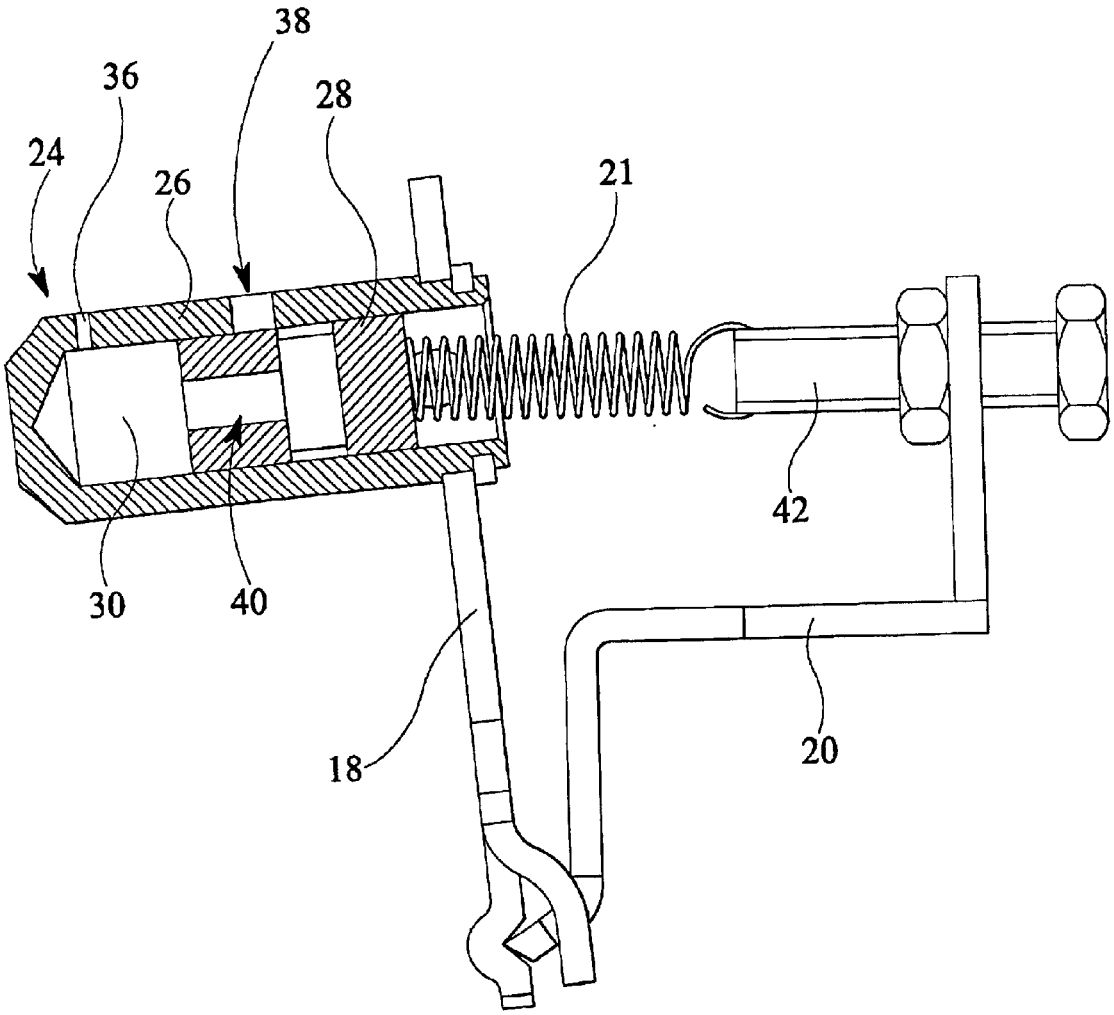
FIG. 3 is a diagrammatic view of a part of a governor in accordance with an alternative embodiment.

FIG. 3 shows an alternative embodiment of the invention, in which the need for the adjustment member 32 in FIG. 1 is removed. The damping arrangement 24 is shown in further detail in FIG. 3, similar parts to those shown in FIG. 1 being denoted with like reference numerals. The housing 26 for the damping arrangement 24 is provided with first and second outlets 36, 38 respectively, the first outlet 36 having a restricted diameter and serving to permit fluid flow only at a relatively low rate. The second outlet 38 has a greater diameter than the first outlet 36 and the damping piston 28 is provided with a passage 40 such that, depending upon the position of the damping piston 28 within the bore provided in the housing 26, fluid within the working chamber 30 is either able to flow through the passage 40 provided in the damping piston 28 and through the second outlet 38 or, if the damping piston 28 obscures the second outlet 38, is able to flow through the restricted outlet 36 such that oscillatory movement of the lever member 18 is damped, as described previously.

The damping spring 21 is provided with an adjustment member 42, such as an anchorage screw, the position of the adjustment member 42 being adjustable so as to adjust the position of the damping spring 21. By adjusting the position of the damping spring 21 such that the damping piston 28 occupies a position in which the working chamber 30 communicates with the second outlet 38 during the dead travel region of the metering valve member 23, the damping arrangement 24 is disabled and the delay in control of fuelling can be avoided, thereby ensuring that the overspeed protection device does not inadvertently trip. In the position illustrated in FIG. 3, the working chamber 30 does not communicate with the second outlet 38 as it is obscured by the damping piston 28, in which case the flow of fluid from the working chamber 30 is restricted by the first outlet 36. However, if the damping piston 28 is urged towards the left in the illustration shown by the adjustment member 42, the working chamber 30 is brought into communication with the second outlet 38, through the passage 40, such that the restricted outlet 36 is by-passed. As the restricted outlet 36 is by-passed, fluid is able to flow into and out of the working chamber 30 at a relatively high rate, such that the damping arrangement 24 will no longer provide a damping function.

In an alternative embodiment to that shown in FIG. 3, the spring 21 and the damping piston 28 may be in abutment or connection with the lever member 18. In addition, in either arrangement the housing 26 of the damping arrangement 24 may be in connection with the adjustment screw 42.

Although in the embodiment shown in FIG. 3, the by-pass flow path is defined, in part, by a passage provided in the damping piston, it will be appreciated that the damping arrangement may be configured in a different manner to define the by-pass means.

What is claimed is:

1. A governor for use in an engine provided with an overspeed protection device which is arranged to trip in the event that engine speed exceeds a predetermined speed, the governor comprising a centrifugal weight mechanism comprising at least one weight coupled to an angularly adjustable metering valve member through a lever member, the metering valve member being operable to control the level of fuelling of the associated engine depending on engine speed, wherein the metering valve member has a range of travel including a region of dead travel in which substantially no variation in fuelling of the engine occurs, and wherein a prevention arrangement comprises an adjustment member for limiting the range of travel of the metering valve member to avoid said region.

2. A governor as claimed in claim 1, for use in an engine having a drive shaft which is arranged to rotate at a speed associated with the engine, wherein the or each weight of the governor is pivotable with respect to and rotatable with the drive shaft, the governor further comprising a thrust washer member, interposed between the or each weight, and a thrust sleeve member which is cooperable with the lever member such that pivotal movement of the or each weight results in axial movement of the thrust sleeve member and, hence, pivotal movement of the lever member.

3. A governor as claimed in claim 2, further comprising a first resilient bias arrangement which acts on the thrust sleeve member to urge the thrust sleeve member towards the thrust washer member.

4. A governor as claimed in claim 3, further comprising a further resilient bias arrangement which serves to urge the lever member into engagement with the thrust sleeve member such that, upon engine start-up, the thrust washer member rotates with the or each weight.

5. A governor as claimed in claim 1, the governor further comprising a damping arrangement associated with the lever member which is arranged to damp oscillatory movement of the lever member, in use, and a prevention arrangement for preventing the overspeed protection device associated with the engine from tripping upon engine start up.

6. A governor as claimed in claim 5, wherein the adjustment member is arranged to act on the lever member so as to limit the extent of movement of the lever member and, hence, the extent of angular movement of the metering valve member.

7. A governor as claimed in claim 6, wherein the adjustment member takes the form of an adjustment screw.

8. A governor as claimed in claim 6, wherein the adjustment member is adjusted such that the metering valve member does not move through the region of dead travel upon engine start up.

9. A governor as claimed in claim 6, wherein the adjustment member is arranged to act directly on the lever member.

10. A governor as claimed in claim 6, wherein the adjustment member is arranged to act on a surface associated with the damping arrangement, thereby to act on the lever member to limit the extent of movement of the lever member.

11. A governor as claimed in claim 5, wherein the damping arrangement takes the form of a hydraulic damping arrangement.

12. A governor for use in an engine provided with an overspeed protection device which is arranged to trip in the event that engine speed exceeds a predetermined speed, the governor comprising a centrifugal weight mechanism comprising at least one weight coupled to an angularly adjustable metering valve member through a lever member, the metering valve member being operable to control the level of fuelling of the associated engine depending on engine speed, the governor further comprising a damping arrangement associated with the lever member which is arranged to damp oscillatory movement of the lever member, in use, and a prevention arrangement for preventing the overspeed protection device associated with the engine from tripping upon engine start up, wherein the damping arrangement takes the form of a hydraulic damping arrangement, and wherein the damping arrangement includes a damping piston which is slidable within a bore provided in a housing against a damping spring arrangement, the bore defining a working chamber for receiving a fluid which applies a force on the damping piston to oppose the damping force.

13. A governor as claimed in claim 12, wherein the damping arrangement includes an anchor member which is adjustable to vary a pre-load of the damping spring arrangement.

14. A governor for use in an engine provided with an overspeed protection device which is arranged to trip in the event that engine speed exceeds a predetermined speed, the governor comprising a centrifugal weight mechanism comprising at least one weight coupled to an angularly adjustable metering valve member through a lever member, the metering valve member being operable to control the level of fuelling of the associated engine depending on engine speed, the governor further comprising a damping arrangement associated with the lever member which is arranged to damp oscillatory movement of the lever member, in use, and a prevention arrangement for preventing the overspeed protection device associated with the engine from tripping upon engine start up, wherein the damping arrangement takes the form of a hydraulic damping arrangement comprising a damping piston and a working chamber for receiving a fluid, whereby fluid pressure within the working chamber acts on a surface associated with the damping arrangement, and a restricted outlet for permitting fluid to flow into and out of the working chamber at a relatively low rate, the damping arrangement being provided with a by-pass arrangement to permit fluid to flow out of the working chamber at a higher, relatively unrestricted rate, thereby by-passing the restricted outlet and causing the damping arrangement to be disabled.

15. A governor as claimed in claim 14, wherein the damping arrangement is provided with an additional outlet through which fluid can flow at a relatively unrestricted rate compared to the rate of flow of fluid through the restricted outlet, the damping piston being movable between a first position in which the additional outlet is obscured by the damping piston, in which case the damping arrangement is enabled, and a second position in which the additional outlet is not obscured by the damping piston, the additional outlet thereby providing a by-pass flow path for fluid within the working chamber so as to disable the damping arrangement.

16. A governor as claimed in claim 15, wherein the by-pass flow path is defined, at least in part, by a passage provided in the damping piston in communication with the working chamber and whereby, when the damping piston is in the second position, the passage communicates with the additional outlet.

17. A governor as claimed in claim 16, wherein the damping piston is slidable within a bore provided in a housing against a damping spring arrangement, the bore defining the working chamber for receiving fluid.

18. A governor as claimed in claim 17 wherein the damping spring arrangement is arranged such that the damping arrangement is disabled during movement of the metering valve member through the region of dead travel upon engine start up.

19. A governor as claimed in claim 18, wherein the damping arrangement further comprises a further adjustment member for adjusting the damping spring arrangement such that the damping piston occupies a position in which the working chamber communicates with the additional outlet during the dead travel region of the metering valve member.

20. A governor as claimed in claim 14, for use in an engine having a drive shaft which is arranged to rotate at a speed associated with the engine, wherein the or each weight of the governor is pivotable with respect to and rotatable with the drive shaft, the governor further comprising a thrust washer member, interposed between the or each weight, and a thrust sleeve member which is cooperable with the lever member such that pivotal movement of the or each weight results in axial movement of the thrust sleeve member and, hence, pivotal movement of the lever member.

* * * * *